United States Patent [19]

Bittl

[11] Patent Number: 4,949,369

[45] Date of Patent: Aug. 14, 1990

[54] X-RAY TUBE

[75] Inventor: Herbert Bittl, Nuremberg, Fed. Rep. of Germany

[73] Assignee: Siemens Aktiengesellschaft, Berlin and Munich, Fed. Rep. of Germany

[21] Appl. No.: 279,922

[22] Filed: Dec. 5, 1988

[30] Foreign Application Priority Data

Feb. 15, 1988 [DE] Fed. Rep. of Germany ... 8801941[U]

[51] Int. Cl.[5] ..... H01J 35/10

[52] U.S. Cl. ..... 378/130; 378/127

[58] Field of Search ..... 378/130, 127

[56] References Cited

U.S. PATENT DOCUMENTS 3,546,511 12/1970 Shimula ..... 378/130

FOREIGN PATENT DOCUMENTS 2748069 5/1979 Fed. Rep. of Germany ..... 378/130

3429799 2/1986 Fed. Rep. of Germany .

60-105146 6/1985 Japan .

*Primary Examiner*—Craig E. Church

*Attorney, Agent, or Firm*—Hill, Van Santen, Steadman & Simpson

[57] ABSTRACT

An x-ray tube has a stationary cathode and a rotating anode contained in an evacuated housing. The anode is mounted on a stationary shaft on bearings. The anode has a hollow interior, in which a stationary heat-absorption member is disposed, also mounted to the shaft. The shaft is in the form of a tube, with the interior thereof being charged by a coolant. The coolant circulates through the heat-absorption member within the hollow interior of the anode to dissipate heat from the anode generated during the production of x-rays.

13 Claims, 1 Drawing Sheet

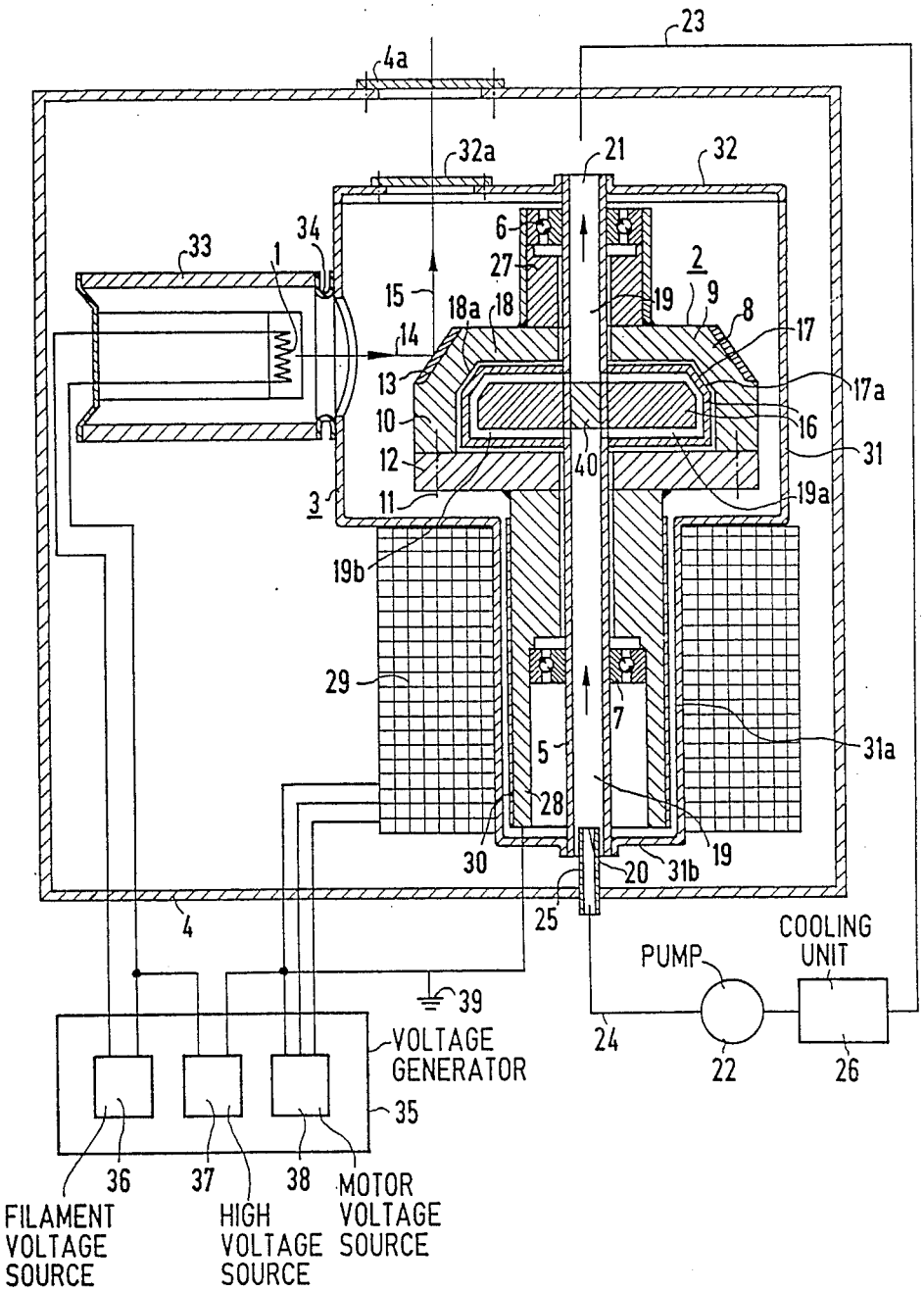
23
4a
32a
21
32
33
34
1
6
27
2
15
18a
18
19
9
8
17
14
13
17a
10
16
12
40
31
3
11
19a
19b
29
7
31a
5
28
30
20
31b
19
4
25
COOLING UNIT
PUMP
39
VOLTAGE GENERATOR
24
22
26
35
36
37
38
FILAMENT VOLTAGE SOURCE
HIGH VOLTAGE SOURCE
MOTOR VOLTAGE SOURCE

X-RAY TUBE

BACKGROUND OF THE INVENTION

1. Field of the Invention

The present invention relates to an x-ray tube and in particular to an x-ray tube of the type having a stationary cathode and a rotating anode with a hollow interior in which a heat-absorption member is disposed.

2. Description of the Prior Art

An x-ray tube is known from German OS 34 29 799 having a stationary cathode with a rotating anode mounted on a shaft, the shaft being seated in the x-ray tube housing by bearings. The anode has a hollow interior in which a heat-absorption member is disposed. The heat-absorption member is connected to the housing via the shaft with a center axis of the shaft being coincident with the center axis of the rotating anode. The heat-absorption member has one end face which engages the interior of the rotating anode. This restricts the mounting and bearings structure for the rotating anode, because it requires both bearing for the anode shaft to be disposed on that side of the anode facing away from the heat-absorption member. It is not possible in this known structure to place the bearings on opposite sides of the anode. As a result, the stiffness or stability of this bearing arrangement is a problem.

In this known x-ray tube, the stray heat generated in the anode during the generation of x-radiation is only partly dissipated to the environment by thermal radiation via the housing. A significant portion of the stray heat is transmitted to the heat-absorption member by thermal conduction, and is eliminated from the heat-absorption member by a coolant. This permits the rotating anode to withstand a higher thermal load because a greater quantity of heat per unit of time can be eliminated.

In this known x-ray tube, to achieve the desired heat elimination from the rotating anode onto the heat-absorption member, it is necessary that the interior wall of the rotating anode and the exterior surface of the heat-absorption member be disposed at an optimally small distance from each other. This means that considerable efforts must be exerted in the manufacture of this known x-ray tube to insure that the center axes of the shaft and of the heat-absorption member are exactly aligned with the center axis of the axle which is used to rotate the anode, otherwise there is the risk that the interior wall of the rotating anode will brush against the heat-absorption member.

SUMMARY OF THE INVENTION

It is an object of the present invention to provide a rotating anode x-ray tube wherein the anode has a heat-absorption member contained therein, which permits a stiff and stable bearing of the rotating anode to be achieved with a low manufacturing outlay.

The above object is achieved in accordance with the principles of the present invention wherein the heat-absorption member attached to the shaft which is used to support the anode, rather than the anode itself, and wherein the shaft is stationary and extends through the housing containing the anode with a bearing at each end of the shaft on opposite sides of the anode. The interior wall of the rotating anode can be disposed extremely close to the exterior surface of the heat-absorption member without significant manufacturing outlay being devoted to maintaining this tolerance, because the heat-absorption member is attached to the same shaft on which the rotating anode is seated. A rigid bearing for the rotating anode also results, because it is disposed between the two bearings on which the shaft is mounted.

In one embodiment of the invention, the shaft is in the form of a hollow tube, with one end of the tube forming an inlet, and the opposite end of the tube forming an outlet, for coolant which circulates around the heat-absorption member to eliminate heat therefrom. This also minimizes heat transfer from the anode to the bearings.

Heat elimination can be further improved in an embodiment wherein the channel for coolant proceeds close to the exterior surface of the heat-absorption member. The channel in a further embodiment may branch into a plurality of sub-channels in the region of the heat-absorption member. In a further embodiment, the interior wall of the rotating anode and/or the exterior surface of the heat-absorption member are blackened.

In a further embodiment of the invention, the x-ray tube may be completely contained within a further, protective housing, filled with an electrically insulating liquid, which also flows through the channel as the coolant. A circulating coolant stream can be created by a pump. In a further embodiment, to insure that the bearings for the rotating anode are thermally stressed as little as possible, the rotating anode may be held at its opposite sides by respective sleeves surrounding the shaft, and consisting of material having a low thermal conductivity. One sleeve may form the rotor of an electrical motor which serves to drive the rotating anode.

BRIEF DESCRIPTION OF THE DRAWINGS

The single drawing shows a side sectional view of an x-ray tube constructed in accordance with the principles of the present invention.

DESCRIPTION OF THE PREFERRED EMBODIMENTS

An x-ray tube constructed in accordance with the principles of the present invention is shown in the drawing, and includes a stationary cathode 1 and a rotating anode 2 contained in an evacuated housing 3. The housing 3 is in turn contained in a protective housing 4, filled with an electrically insulating liquid, for example, insulating oil. The anode 2 is rotatably mounted by two bearings 6 and 7 on a stationary shaft 5. The shaft 5 is connected to the housing 3.

The anode 2 is a dynamically balanced hollow element. The anode 2 has a section 8, in the form of a truncated cone, and a radially inwardly directed flange 9. The larger end of the section 8 is connected to a tubular section 10. The sections 8 and 10, and the flange 9, form a unitary element. The open end of the tube section 10 is covered by an annular disk 12, attached to the tubular section 10 by screws 11 which are schematically indicated. The truncated section 8 of the anode 2 is provide with a layer 13, consisting of tungsten-rhenium alloy on which an electron beam is incident, emanating from the cathode 1. The interaction of the electron beam 14 with the layer 13 generates an x-ray beam, schematically indicated at 15, which emerges through a beam exit window **4*a* in the protective housing 4**.

A stationary, dynamically balanced heat-absorption member 16 is disposed in the hollow interior of the rotating anode 2, and is connected to the housing 3 via the shaft 5. A substantial portion of the stray heat arising in the generation of the x-ray beam 15 is radiated onto the exterior surface 17 of the heat-absorption member 16 from the interior wall 18 of the rotating anode 2.

As noted above the heat-absorption member 16 is connected to the housing 3 by attachment to the shaft 5. The shaft 5 extends through the housing 3, and is connected to the housing 3 in the vacuum-tight fashion at its opposite ends. At one end of the shaft 5, the rotating anode 2 is seated by the bearing 6, and is seated at the opposite end of the shaft 5 by the bearing 7. The shaft 5 has a hollow interior which forms a portion of a channel 19, in which a coolant flows for eliminating the heat transmitted from the rotating anode 2 onto the heat-absorption member 16. The channel 19 branches into a plurality of sub-channels in the region of the heat-absorption member 16, only two of these sub-channels, sub-channels **19*a* and 19*b*, being visible in the drawing. These channels proceed in the heat-absorption member 16 close to the surface 17 thereof, so that effective heat elimination by the coolant is guaranteed. The channel 19 is closed by a plug 40 in the region of the heat-absorption member 16, so that the coolant flows into the sub-channels, such as sub-channels 19*a* and 19*b*, through openings in the wall of the shaft 5 preceding the plug 40 in the coolant flow direction. After circulating within the heat-absorption member 16 the coolant returns to the portion of the channel 19 disposed following the plug 40 through further openings in the wall of the shaft 5** following the plug in the coolant flow direction.

Heat transmission by radiation from the rotating anode 2 onto the heat-absorption member 16 can be promoted by blackening one or both of the interior wall 18 of the anode 2 and the exterior surface of the heat-absorption member 16. This can be accomplished by providing one or both of those surfaces with a layer of black material, schematically indicated **17*a* and 18*a***.

As can be seen in the drawing by the arrows indicating the flow direction in the channel 19, the inlet 20 of the channel 19 is disposed at one end of the shaft 5, and the outlet 21 of the channel 19 is disposed at the other end of shaft 5. The liquid contained in the protective housing 4 flows through the channel 19 as coolant. A liquid circulation stream is generated by a pump 22 which takes in liquid via a line 23, which begins in the region of the outlet 21. The pump supplies liquid to a pipe socket 25 via a line 24, the pipe socket 25 being connected to the protective housing 4, and projecting into the inlet 20 of the channel 19. A cooling unit 26 is connected in the circulation path preceding the pump 22. If such a cooling unit 26 is not required, cooling circulation can still be generated within the protective housing 4, in which case a pump would then be provided in the interior of the protective housing 4, which would supply liquid contained within the protective housing 4 to the inlet of the channel 19 to produce the desired stream circulation. No lines proceeding outside of the protective housing 4 would then be required.

At each of its opposite ends, i.e. at the flange 9 and the disk 12, the rotating anode 2 is provided with respective sleeves 27 and 28. The sleeves 27 and 28 consist of a material having a low thermal conductivity, and each sleeve has a central bore therein which respectively receives the bearing 6 or the bearing 7. The sleeve 28 may form the rotor of an electric motor for driving the rotating anode 2, in combination with a stator 29 disposed outside of the housing 3. If the material of the sleeve 28 does not have the electrical properties required for functioning as a rotor the sleeve 28 may be provided with a suitable coating 30 for this purpose.

Differing from the embodiment shown in the drawing, the heat-absorption 16 and the shaft 5 may be constructed from a plurality of joined sections of materials having good thermal conductivity. Various measures may be undertaken to minimize heat transmission between the sleeves 27 and 28 and the respective bearings 6 and 7 disposed therein. For example, the outer race of each of the bearings 6 and 7 may be provided with a plurality of small projections, so that the outer race press as against the sleeve 27 or 28 only in punctiform fashion.

The details of the structure of the rotating anode 2 shown in the drawing are exemplary only. The inventive concept disclosed herein is that the rotating anode 2 be a hollow member with a heat-absorption member contained therein, charged by a coolant. As a consequence of the structure of the rotating anode 2 as a hollow member, it has a low mass moment of inertia, so that a relatively short time to bring the anode 2 up to speed is required.

As can be seen in the drawing, the housing 3 consists of two metallic housing sections 31 and 32 joined together by welding. The housing section 31 is in the form of a chamber with a tubular projection **31*a*. The exterior surface of the projection 31*a* is surrounded by the stator 29, with the sleeve 28 forming the rotor and having the coating 30, disposed inside of the tubular projection 31*a*. The free end of the projection 31*a* is covered with a base 31*b*, having a bore engaging one end of the shaft 5. The shaft 5 is joined to the base 31*b* of the projection 31*a*** by welding.

The opposite end of the shaft 5 is received in a bore in the housing section 32, and is also attached thereto by welding.

A tubular insulator 33, which accepts the cathode 1, is laterally attached to the housing section 31 in the region of the anode 2. The insulator 33 is connected by welding to the housing section 31 with the interposition of a suitably shaped metal ring 34.

The housing section 32 is provided with a beam exit window **32*a* in substantial registry with the window 4*a* in the protective housing 4. The x-ray beam passes through both of these windows. The window 32*a* may consist, for example, of beryllium. The x-ray tube in connected to a schematically indicated voltage generator 35. The voltage generator 35 includes a filament voltage source 36 for the filament voltage of the cathode 1. The voltage generator 35 also includes a high voltage source 37 for generating the high voltage between the anode 2 and the cathode 1 required for generating x-rays. Lastly, the generator 35 also includes a motor voltage source 38 which supplies the operating voltage for the electric motor for driving the rotating anode 2. The lines leading from the voltage generator 35** to various components of the x-ray tube are schematically indicated.

The rotating anode 2 and one terminal of the stator 29 are at a common potential, such as ground potential 39. Because no insulating measures are undertaken by the rotating anode 2 and the housing 3, all components of the x-ray tube lie at ground potential 39. The x-ray tube is also operated in unipolar fashion. This offers the advantage that no insulators are required between the stator 29 of the electric motor for driving the anode 2, and the housing 3. The stator 29 can thus be put directly in place in the tubular projection 31*a* of the housing section 31, as shown in the drawing. The electric motor thus formed for driving the rotating anode 2 thus has an extremely small air gap, with the advantage of an extremely good penetration coefficient. This results in a very short time for the electric motor, and thus the rotating anode 2, to get up to speed.

Although modifications and changes may be suggested by those skilled in the art it is the intention of the inventor to embody within the patent warranted hereon all changes and modifications as reasonably and properly come within the scope of his contribution to the art.

We claim:

1. An x-ray tube comprising:

an evacuated housing;

a stationary shaft in said housing;

a stationary cathode and a rotating anode disposed in said housing for generating x-rays, and thereby also generating heat in said anode, said rotating anode having a hollow interior with an interior wall;

bearing means disposed on opposite sides of said anode for rotatably seating said anode on said shaft;

means for rotating said anode;

a heat-absorption member attached to said shaft and disposed in said hollow interior of said anode spaced from said interior wall; and means for charging said heat-absorption member with a coolant for eliminating heat from said heat-absorption member transferred thereto by said rotating anode.

2. An x-ray tube as claimed in claim 1, wherein said means for charging said heat-absorption member with a coolant includes a channel disposed in said stationary shaft, said channel having an inlet and an outlet connected to a source for said coolant, with said coolant flowing through said channel.

3. An x-ray tube as claimed in claim 2, wherein said heat-absorption member has an exterior surface, and further comprising a channel in said heat-absorption member disposed adjacent said surface communicating with said channel in said shaft, said coolant also flowing through said channel in said heat-absorption member.

4. An x-ray tube as claimed in claim 2, wherein said heat-absorption member has a exterior surface, and further comprising a plurality of sub-channels in said heat-absorption member disposed adjacent said exterior surface, said plurality of channels communicating with said channel in said stationary shaft and said coolant flowing through said plurality of channels.

5. An x-ray tube as claimed in claim 2, wherein said shaft has opposite ends, and wherein said inlet and said outlet are disposed at said opposite ends of said shaft.

6. An x-ray tube as claimed in claim 1, wherein said interior wall of said rotating anode is blackened.

7. An x-ray tube as claimed in claim 1, wherein said heat-absorption member has an exterior surface, and wherein said exterior surface is blackened.

8. An x-ray tube as claimed in claim 1, further comprising:

a protective housing in which said evacuated housing is disposed, and defining a volume surrounding said evacuated housing, said means for charging being in fluid communication with said volume; and an insulating fluid filling said volume and simultaneously serving as said coolant.

9. An x-ray tube as claimed in claim 1, further comprising:

respective sleeves consisting of material having a low thermal conductivity disposed on said opposite sides of said anode, each of said sleeves having an opening therein receiving said bearing means.

10. An x-ray tube as claimed in claim 9, wherein said means for rotating said anode is an electric motor, and wherein one of said sleeves forms a rotor for said electric motor.

11. An x-ray tube comprising:

an evacuated housing;

a hollow stationary shaft in said housing;

a stationary cathode and a rotating anode disposed in said housing for generating x-rays, and thereby also generating heat in said anode, said rotating anode having a hollow interior with an interior wall;

bearing means disposed on opposite sides of said anode for rotatably seating said anode of said shaft;

means for rotating said anode;

a heat-absorption member attached to said shaft and disposed in said hollow interior of said anode spaced from said interior wall, said heat-absorption member having at least one channel therein in communication with the interior of said hollow stationary shaft; and means for charging said hollow interior of said stationary shaft and said channel in said heat-absorption member with a coolant for eliminating heat from said heat-absorption member transferred thereto by said rotating anode.

12. An x-ray tube comprising:

an evacuated housing;

a stationary shaft in said housing having a hollow interior with an inlet and an outlet;

a stationary cathode and a rotating anode disposed in said evacuated housing for generating x-rays, and thereby also generating heat in said anode, said rotating anode having a hollow interior with an interior wall;

bearing means disposed on opposite sides of said anode for rotatably seating said anode on said shaft;

means for rotating said anode;

a heat-absorption member attached to said shaft and disposed in said hollow interior of said anode spaced from said interior wall, said heat-absorption member having at least one channel therein in fluid communication with said hollow interior of said shaft;

a protective housing in which said evacuated housing is disposed, and defining a volume surrounding said evacuated housing;

insulating fluid filling said volume;

pump means having an intake disposed in said volume and an output directly connected to said inlet of said hollow interior of said shaft for circulating said insulating fluid through said hollow interior of said shaft, through said at least one channel in said heat-absorption member, and out said outlet of said hollow interior of said shaft to eliminate heat from said heat-absorption member transferred thereto by said rotating anode.

13. An x-ray tube as claimed in claim 12, wherein said pump means is disposed outside of said protective housing, and said x-ray tube further comprising:

means disposed between said pump intake and said pump output for eliminating heat from said insulating fluid.

* * * * *